United States Patent [19]

Aamodt

[11] 4,345,494

[45] Aug. 24, 1982

[54] OIL FILTER WRENCH

[76] Inventor: Norman O. Aamodt, R.D. #5, Coatesville, Pa. 19320

[21] Appl. No.: 201,421

[22] Filed: Oct. 28, 1980

[51] Int. Cl.[3] ..... B25B 13/52

[52] U.S. Cl. ..... 81/64

[58] Field of Search ..... 81/64, 3.43

[56] References Cited

U.S. PATENT DOCUMENTS

| | | | |
|---|---|---|---|
| 689,325 | 12/1901 | Sauds | 81/64 |
| 840,496 | 1/1907 | Justen | 81/64 |
| 1,525,358 | 2/1925 | Bergen | 81/64 |
| 2,481,055 | 9/1949 | Whitaker | 81/64 |
| 4,145,938 | 3/1979 | Laird | 81/64 |

FOREIGN PATENT DOCUMENTS

| | | | |
|---|---|---|---|
| 7712 | 6/1932 | Australia | 81/64 |

*Primary Examiner*—James L. Jones, Jr.

[57] ABSTRACT

A strap wrench especially designed for removing oil filters. The strap is retained at the end of the wrench by a retainer structure so that the strap is readily tightened on the oil filter and can be used to loosen the oil filter with minimum torque applied to the handle of the wrench.

2 Claims, 2 Drawing Figures

OIL FILTER WRENCH

BACKGROUND OF THE INVENTION

1. Field of the Invention

The invention is directed to a strap wrench and, more particularly, to a strap wrench especially designed for removing oil filters on cars.

2. Description of the Prior Art

U.S. Pat. No. 4,145,938 is directed to a strap wrench that uses a specially designed camming surface to anchor the strap in position on the workpiece.

U.S. Pat. No. 1,525,358 is directed to a strap wrench similar in structure to that of the above patent.

Australian Pat. No. 7712/32 discloses a strap wrench using a relatively flat end with a strap retainer structure holding the two ends of the strap on the wrench handle.

U.S. Pat. Nos. 689,325 and 840,496 disclose strap wrenches that use a ring structure to fasten the one end of the strap to the body of the wrenches.

SUMMARY OF THE INVENTION

The strap wrench has the one end of the strap fastened to the wrench handle by way of a ring structure. A retainer loop is positioned on the wrench handle and the strap passes both ways through the retainer loop to form the strap loop that engages the workpiece. The flat end of the wrench body and a corner thereof assists in preventing the strap from slipping out of position. The other end of the strap is also positioned within the ring structure to assist in holding the strap in position on the workpiece.

DESCRIPTION OF THE PREFERRED EMBODIMENT

Figure 1:
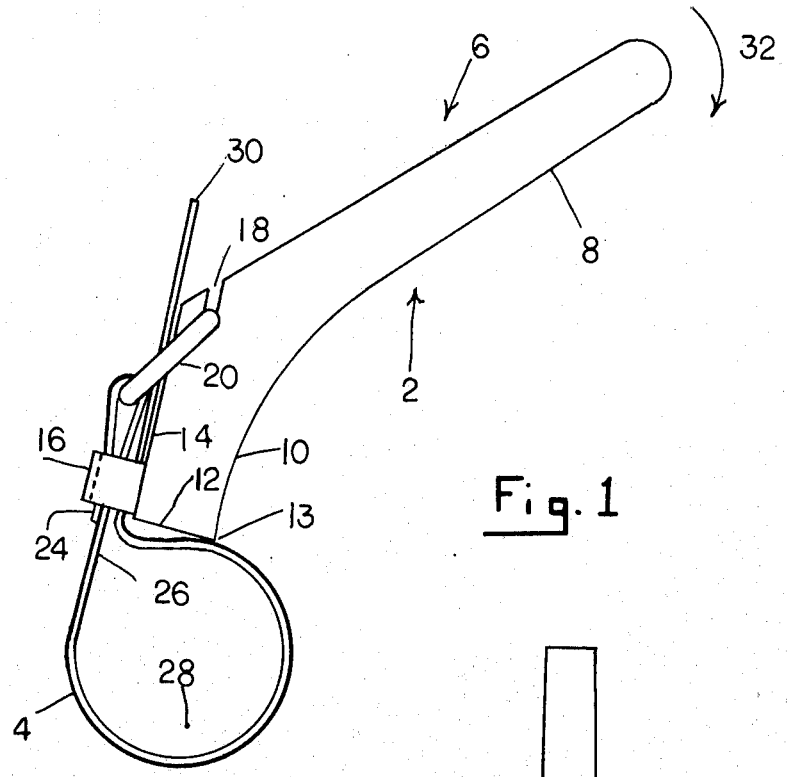
FIG. 1 is a side view of the strap wrench invention in use.

The strap wrench 2 is best shown in FIG. 1. The wrench is composed primarily of a strap 4 and a handle portion 6. The handle portion is composed of a handle member 8 and a body member 10 which are normally molded from plastic as an integral unit. The body member 10 is slightly off-set from the longitudinal axis of the handle member 8.

The body member has a flat end 12 at the end of the body opposite from where the body member is connected to the handle member. Adjacent to this end 12 and on the upper part of the body member there is a surface 14 on which the strap is positioned and a retainer loop structure 16 is mounted on this flat surface 14 adjacent to the end 12. A corner 13 is provided adjacent end 12.

Figure 2:
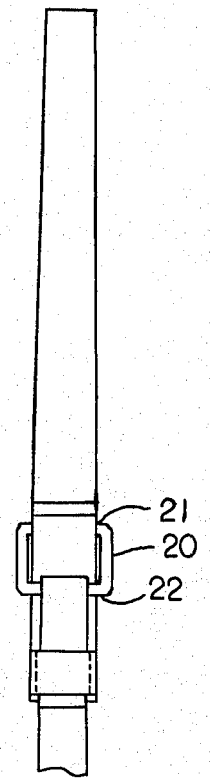
FIG. 2 is a top view of the strap wrench.

At the point where the body member and handle member blend together, there is provided a groove 18. This groove extends across the width of the body member and is just below the flat surface 14 of the body member. A ring or link structure 20 is positioned in the groove. As best seen in FIG. 2, the ring 20 has one side 21 thereof slipped into the groove 18. Two adjacent sides extend parallel with the handle member of the strap wrench and the side 22 of the ring structure opposite from the side 21 in groove 18 is positioned above the flat surface 14. This side 22 in FIG. 2 has one end of the strap fastened thereto. The one end of the strap is looped about itself and is stitched, sonic welded or by other means fastened into position so that the one end of the strap wrench is formed into a loop fastening around element 22 and due to the stitching, etc. forms a permanent closed loop. The end of the strap is passed around a sufficient portion of the body of the strap so that both the end of the strap 24 and the portion 26 of the body of the strap to which it is fastened thereto both fit within the retainer loop structure 16, but the end 24 does not pass beyond the end of the retainer loop.

The remaining portion of the strap 4 is then formed in a large loop 28 and the opposite end 30 of the strap then passes through the retainer loop structure under the stitched looped end of the strap and it further passes within ring structure 20 and out along the top side of the handle 8 as best shown in FIG. 1. By pulling on the end 30 of the strap, the size of the loop 28 can be adjusted. When the strap is pulled tight around some object, the ring structure 20 pulls down in the direction towards the flat surface 14 and, thus, a pinching action occurs on the end 30 of the strap to frictionally hold it between the flat surface 14 and the closed loop stitched in the opposite end of the strap.

When the strap wrench is in use, it is so positioned on an object so that the strap wrench would be pulled in the direction of the arrow 32 which then pushes the flat surface 12 tight up against the strap 4 and cause corner 13 to indent the strap and this provides a very positive clamping action against the strap 4 to prevent the strap from slipping on the material being held within the loop 28 of the strap. The corner 13 and the flat surface 12 function to compress the gap in the loop, therefore shortening the length of the strap and causing increased tension in the strap. It has been found that once the strap is in position and has been used to loosen or tighten an object the ring structure 20 must be pushed upward away from the flat surface 14 in order to release the strap end 30.

The strap wrench described above is very economical to manufacture since it is composed of basically three parts. The one part being a very simple molded plastic handle part to which is positioned the second part which is the ring structure 20 and then these two elements retain a strap structure 4 in the loop configuration shown in FIG. 1. Through the use of the combination action of the ring structure, the retainer loop structure, the flat surface 12 and corner 13, the abovedescribed strap wrench will provide a very firm, non-slipping grip on any object so that it may be readily unfastened or tightened. The abovedescribed strap wrench is particularly useful for placing and removing oil filters from automobiles.

What is claimed is:

1. A strap wrench comprising:

(a) a handle portion having a body member and a handle member connected together, (b) said body member having an axis extending of an obtuse angle to the axis of the handle member and having a flat end perpendicular to the axis of the body and an outer square corner opposite the end of the body member connected to the handle member, (c) between said two ends and adjacent said flat end there being a strap mounting surface and over that surface there being a retainer loop structure, and (d) a strap with one end of said strap being fastened to said body member, said strap passing through said retainer loop structure, then said strap forming a loop and passing back through said retainer loop structure under said strap portion already positioned in said retainer loop structure.

2. The strap wrench of claim 1 wherein one end of said strap is fastened to a ring structure inserted in a groove cut in said body member and the other end of said strap passes freely through said ring structure.

* * * * *